US009348263B2

(12) United States Patent
Iketani et al.

(10) Patent No.: US 9,348,263 B2
(45) Date of Patent: May 24, 2016

(54) DEVELOPING DEVICE AND IMAGE FORMING APPARATUS COMPRISING DOWNSTREAM INCLINED CONVEYANCE FIN

(71) Applicant: KYOCERA Document Solutions Inc., Osaka-shi (JP)

(72) Inventors: Takeshi Iketani, Osaka (JP); Hideki Takeda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/796,701

(22) Filed: Jul. 10, 2015

(65) Prior Publication Data

US 2016/0018761 A1 Jan. 21, 2016

(30) Foreign Application Priority Data

Jul. 17, 2014 (JP) ..... 2014-146527

(51) Int. Cl.
*G03G 15/08* (2006.01)

(52) U.S. Cl.
CPC ..... *G03G 15/0891* (2013.01)

(58) Field of Classification Search
CPC ..... G03G 15/0891; G03G 15/0893
USPC ..... 399/254
See application file for complete search history.

(56) References Cited

U.S. PATENT DOCUMENTS 4,980,724 A * 12/1990 Tanaka ..... G03G 15/0822 366/319
5,510,881 A * 4/1996 Smith ..... G03G 15/0822 198/550.6
5,963,766 A * 10/1999 Okuno ..... G03G 15/0822 399/254
8,892,011 B2 * 11/2014 Sato ..... G03G 15/0812 399/284
9,046,819 B2 * 6/2015 Furuki ..... G03G 15/0879 399/258
2007/0183813 A1 * 8/2007 Iwata ..... G03G 15/0877 399/227
2011/0013943 A1 * 1/2011 Sakamoto ..... G03G 15/0887 399/254
2011/0150537 A1 * 6/2011 Watanabe ..... G03G 15/0839 399/256
2013/0156468 A1 * 6/2013 Hayashi ..... G03G 15/0893 399/254
2015/0078787 A1 * 3/2015 Gyotoku ..... G03G 15/0893 399/254

FOREIGN PATENT DOCUMENTS

JP 3070414 U 5/2000

* cited by examiner

*Primary Examiner* — Billy Lactaoen
*Assistant Examiner* — Arlene Heredia Ocasio
(74) *Attorney, Agent, or Firm* — Studebaker & Brackett PC

(57) ABSTRACT

A developing device includes a developer container, a developer bearing member, and a plurality of stirring conveyance members. The developer container includes a plurality of developer conveyance paths and communication sections. At least one of the stirring conveyance members includes a conveyance fin configured to convey the developer toward one of the communication portions. The conveyance fin protrudes from a portion of the stirring conveyance member, the portion being located at a downstream end of the developer conveyance path in terms of a developer conveyance direction in the developer conveyance path. The conveyance fin is inclined at a specified angle to a direction of a rotational shaft of the at least one of the stirring conveyance members so that the developer being conveyed is turned by the conveyance fin in a direction at an acute angle to the developer conveyance direction in the developer conveyance path.

9 Claims, 6 Drawing Sheets

DEVELOPING DEVICE AND IMAGE FORMING APPARATUS COMPRISING DOWNSTREAM INCLINED CONVEYANCE FIN

INCORPORATION BY REFERENCE

The present application claims priority under 35 U.S.C. §119 to Japanese Patent Application No. 2014-146527, filed Jul. 17, 2014. The contents of this application are incorporated herein by reference in their entirety.

BACKGROUND

The present disclosure relates to a developing device including a stirring member that stirs and conveys a developer and to an image forming apparatus.

In general, an electrophotographic image forming apparatus includes a developing device. One-component development schemes and two-component development schemes are known as development schemes using a dry toner that are employed in generic developing devices. In the one-component development schemes, a one-component developer consisting only of a magnetic toner is used. In the two-component development schemes, a two-component developer including a non-magnetic toner and a magnetic carrier for charging the toner is used, and an electrostatic latent image on an image bearing member (photosensitive member) is developed with a magnetic brush that is formed on a developing roller from the magnetic carrier and the toner.

In a generic developing device, toner is consumed during development. The developing device is therefore provided with a toner sensor that detects a toner concentration or a toner amount, and toner is newly supplied in an amount that makes up the consumed amount. Image defects such as toner scattering and fogging may occur if the newly supplied toner is not sufficiently charged. In the two-component development schemes, therefore, the toner and the carrier need to be sufficiently stirred and mixed to charge the toner to a desired charge. Likewise, in the one-component development schemes, the toner remaining in the developing device and the newly supplied toner need to be sufficiently mixed to give a uniform charge distribution.

To this end, a widely-known method involves conveying a developer by circulating the developer through a developer circulation pathway provided within a developing device while stirring and mixing the developer using a stirring conveyance member disposed in the circulation pathway. The stirring conveyance member has a shape of a screw including a rotational shaft and a helical blade. More specifically, an inner space of a developer container is divided by a partition wall into two developer conveyance paths elongated in a longitudinal direction of the developer container. Each of the two developer conveyance paths includes one stirring conveyance member. The two developer conveyance paths and two developer transfer sections form the developer circulation pathway. One of the developer transfer sections allows communication between one end of one developer conveyance path and one end of the other developer conveyance path. The other of the developer transfer sections provides communication between the other end of the one developer conveyance path and the other end of the other developer conveyance path.

Requirements to increase image formation speed and to decrease the size of image forming apparatuses have necessitated increase in circulation speed (i.e., conveyance speed) of a developer in a developing device. Examples of common methods of increasing the developer conveyance speed include a method involving increasing the rotational speed of stirring conveyance members, and a method involving widening the helical pitch of helical blades.

Such common methods increase the developer conveyance speed in an axial direction of stirring conveyance members. However, the conveyance speed is not significantly increased at communication sections (i.e., developer transfer sections) formed at turn-around sections of a circulation pathway. Consequently, the developer accumulates at the developer transfer sections, and therefore may be packed into an aggregation or may adhere to an inner wall of a developer container.

To solve such a problem, methods have been proposed for reducing concentration of a developer at developer transfer sections. For example, a developing device has a plate-like paddling fin disposed at a downstream end of a stirring conveyance member in terms of a developer conveyance direction to improve the developer conveyance ability at a developer transfer section. The paddling fin extends outward in a radial direction of the stirring conveyance member so as to be opposite to the developer transfer section.

SUMMARY

According to a first aspect of the present disclosure, a developing device includes a developer container, a developer bearing member, and a plurality of stirring conveyance members. The developer container includes a plurality of developer conveyance paths arranged substantially parallel to one another, and communication sections which are located at opposite ends of the developer conveyance paths and through which a developer is transferred. The developer bearing member is rotatably supported by the developer container and configured to bear the developer on a surface thereof. The plurality of stirring conveyance members are disposed corresponding to the plurality of developer conveyance paths. Each of the stirring conveyance members is located within the corresponding developer conveyance path and conveys the developer in a longitudinal direction of the developer conveyance path while stirring the developer. At least one of the stirring conveyance members includes a conveyance fin configured to convey the developer toward one of the communication sections. The conveyance fin protrudes from a portion of the at least one of the stirring conveyance members, the portion being located at a downstream end of the developer conveyance path in terms of a developer conveyance direction in the developer conveyance path and opposite to the one of the communication sections. The conveyance fin is inclined at a specified angle to a direction of a rotational shaft of the at least one of the stirring conveyance members so that the developer being conveyed is turned by the conveyance fin in a direction at an acute angle to the developer conveyance direction in the developer conveyance path.

According to a second aspect of the present disclosure, an image forming apparatus includes the developing device according to the first aspect of the present disclosure.

DETAILED DESCRIPTION

Figure 1:
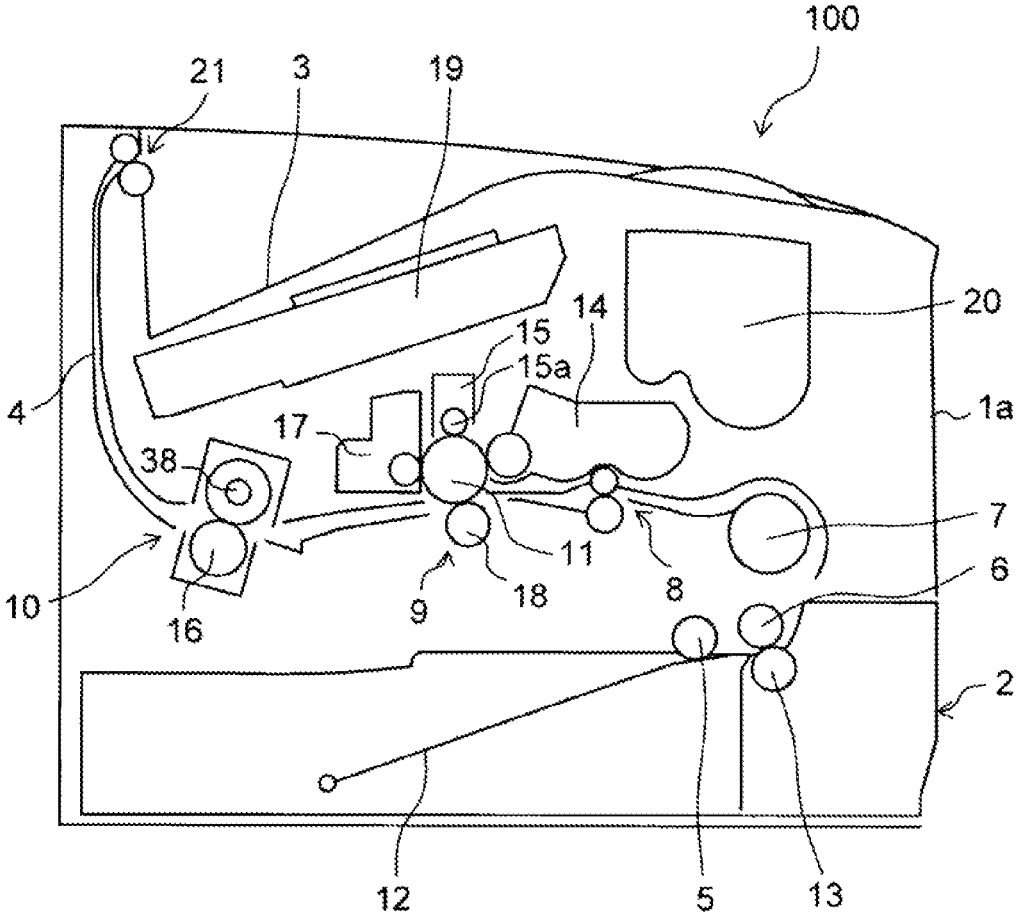
FIG. 1 is a cross sectional view illustrating general configuration of an image forming apparatus including a developing device of the present disclosure.

Hereinafter, embodiments of the present disclosure will be described with reference to the accompanying drawings. FIG. 1 is a cross sectional view illustrating general configuration of an image forming apparatus 100 in which a developing device 14 of the present disclosure is mounted. A front side of the image forming apparatus is on the right side of the page of FIG. 1. The image forming apparatus 100 is not particularly limited and may be for example a color printer, a copier, a facsimile machine, or a multifunction peripheral, although it is a monochrome printer in the present embodiment. The multifunction peripheral includes two or more of copier, printer, and facsimile machine functions.

The image forming apparatus 100 includes a paper feed cassette 2, a paper ejection section 3, a pickup roller 5, a feed roller 6, an intermediate conveyance roller 7, a registration roller pair 8, an image forming section 9, a fixing section 10, a retard roller 13, a toner container 20, and an ejection roller pair 21. The image forming apparatus 100 has a paper conveyance path 4.

The paper feed cassette 2 that stores therein a stack of paper sheets is disposed in a lower part of a main body 1*a* of the image forming apparatus 100. The paper conveyance path 4 is formed above the paper feed cassette 2. The paper conveyance path 4 extends substantially horizontally from front to back of the main body 1*a* and further extends upward to reach the paper ejection section 3 located at a top surface of the main body 1*a*. The pickup roller 5, the feed roller 6, the intermediate conveyance roller 7, the registration roller pair 8, the image forming section 9, the fixing section 10, and the ejection roller pair 21 are arranged along the paper conveyance path 4 in the noted order from an upstream end of a paper conveyance direction.

The paper feed cassette 2 has a paper loading plate 12 that is supported so as to be turnable relative to the paper feed cassette 2. Paper loaded on the paper loading plate 12 is picked up and sent by the pickup roller 5 toward the paper conveyance path 4. If a plurality of sheets of paper are sent by the pickup roller 5, the feed roller 6 and the retard roller 13 separate the sheets from one another, and only the uppermost sheet is conveyed. A sheet of paper sent to the paper conveyance path 4 is turned, in terms of conveyance direction thereof, toward the back of the main body 1*a* by the intermediate conveyance roller 7 and then conveyed to the registration roller pair 8. The sheet of paper is then supplied into the image forming section 9 at a timing adjusted by the registration roller pair 8.

The image forming section 9 forms a toner image on paper by an electrophotographic process. The toner image is an example of a developer image. The image forming section 9 includes a photosensitive drum 11, a charger 15, a developing device 14, a cleaning section 17, a transfer roller 18, and a light scanning unit 19. The photosensitive drum 11 is axially supported so as to be rotatable clockwise in FIG. 1. The charger 15, the developing device 14, and the cleaning section 17 are disposed around the photosensitive drum 11. The transfer roller 18 is disposed opposite to the photosensitive drum 11 with the paper conveyance path 4 therebetween. The light scanning unit 19 is disposed above the photosensitive drum 11. The toner container 20 for supply of a toner to the developing device 14 is disposed above the developing device 14. The toner is an example of a developer.

The charger 15 includes a conductive rubber roller 15*a* connected with a power source, not shown. The conductive rubber roller 15*a* is disposed in contact with the photosensitive drum 11. The conductive rubber roller 15*a* is caused to rotate in contact with a surface of the photosensitive drum 11 by the rotation of the photosensitive drum 11. A predetermined voltage is applied to the conductive rubber roller 15*a* while the conductive rubber roller 15*a* is rotating. As a result, the surface of the photosensitive drum 11 is uniformly charged.

Subsequently, a light beam based on image data input from an external device such as a personal computer is emitted from the light scanning unit 19 onto the photosensitive drum 11. As a result, an electrostatic latent image is formed on the photosensitive drum 11. The toner supplied from the developing device 14 adheres to the electrostatic latent image, and thus a toner image is formed on the surface of the photosensitive drum 11. Paper is fed from the registration roller pair 8 to a transfer nip between the photosensitive drum 11 and the transfer roller 18 at a specified timing. Then, the toner image on the surface of the photosensitive drum 11 is transferred onto the paper by the transfer roller 18.

The paper on which the toner image has been transferred is separated from the photosensitive drum 11 and conveyed toward the fixing section 10. The fixing section 10 is located downstream of the image forming section 9 in terms of the paper conveyance direction. The fixing section 10 has a heating roller 38 and a pressure roller 16. The heating roller 38 is heated by a heating member such as a heater. The pressure roller 16 is in pressed contact with the heating roller 38. The paper onto which the toner image has been transferred in the image forming section 9 is heated and pressed by the heating roller 38 and the pressure roller 16. As a result, the toner image transferred onto the paper is fixed on the paper.

The paper on which the toner image has been fixed, that is, the paper on which an image has been formed is ejected to the paper ejection section 3 by the ejection roller pair 21. Meanwhile, toner remaining on the surface of the photosensitive drum 11 after the transfer is removed by the cleaning section 17. Subsequently, the photosensitive drum 11 is charged again by the charger 15, and thereafter image formation is performed in the same manner as described above.

Figure 2:
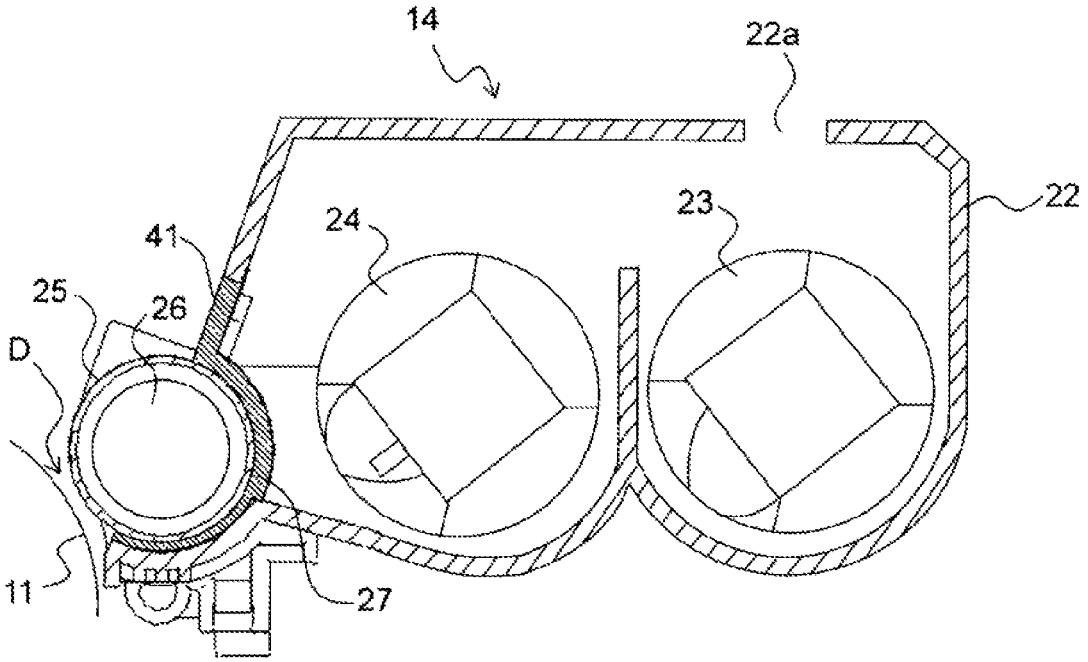
FIG. 2 is a cross sectional side view of a developing device according to an embodiment of the present disclosure.

FIG. 2 is a cross sectional view illustrating general configuration of the developing device 14 according to an embodiment of the present disclosure that is for use in the image forming apparatus 100. The developing device 14 includes a developer container 22, a first stirring conveyance member 23 (stirring conveyance member), a second stirring conveyance member 24 (stirring conveyance member), a developing roller 25 (developer bearing member), and a limiting member 41. The developer container 22 contains a developer. In the present embodiment, the developer is a one-component magnetic developer. The first stirring conveyance member 23 and the second stirring conveyance member 24 stir and convey the developer. Hereinafter, a toner will be used as an example of the developer.

The first stirring conveyance member 23 and the second stirring conveyance member 24 are disposed rotatably within the developer container 22 with a partition wall 22*b* therebetween. The first stirring conveyance member 23 includes a helical blade elongated in a helical shape in an axial direction of the first stirring conveyance member 23. The second stirring conveyance member 24 includes a helical blade elongated in a helical shape in an axial direction of the second stirring conveyance member 24. The first stirring conveyance member 23 and the second stirring conveyance member 24 stir the toner while rotating. The toner being stirred is circulated within the developer container 22 along a longitudinal direction (direction perpendicular to the page of FIG. 2) of the developer container 22 through a first communication section 22*e* (communication section) and a second communication section 22*f* (communication section) that are provided at opposite ends of the partition wall 22*b* (see FIG. 3). As a result, friction between particles of the toner is generated, and thus the toner is charged. The toner is then supplied to the developing roller 25 by the second stirring conveyance member 24.

The developing roller 25 is formed from a non-magnetic material such as aluminum in a cylindrical shape and includes therein a magnetic pole member 26. The developing roller 25 is rotatably supported within the developer container 22 at a location adjacent to the second stirring conveyance member 24. The developing roller 25 is exposed at an opening of the developer container 22 and located opposite to the photosensitive drum 11 serving as an image bearing member with a specified space therebetween. An area where the developing roller 25 is opposed to the photosensitive drum 11 provides a development area D for supplying the toner carried by the developing roller 25 to the photosensitive drum 11.

The magnetic pole member 26 has a plurality of magnetic pole portions arranged in a circumferential direction of the magnetic pole member 26 and generates a magnetic field toward a surface of the developing roller 25 to cause the charged toner to be carried on the surface of the developing roller 25.

The limiting member 41 has a blade-like shape and limits the thickness of the toner on the surface of the developing roller 25 to a predetermined layer thickness. The limiting member 41 is attached to the developer container 22 at a location upstream of the development area D in terms of a rotation direction of the developing roller 25 with a predetermined distance from the surface of the developing roller 25 along the longitudinal direction of the developer container 22.

A pair of side seals 27 each having a substantially C-shaped cross section is provided at opposite axial ends of the developing roller 25 along an outer circumferential surface of the developing roller 25. The side seals 27 are contact seals formed from an elastic member such as felt and sponge. The side seals 27 are in pressed contact with the outer circumferential surface of the developing roller 25 and thus prevent toner leakage from a gap between the outer circumferential surface of the developing roller 25 and the developer container 22.

The toner supplied by the second stirring conveyance member 24 is carried on the surface of the developing roller 25. The toner is carried on the surface of the developing roller 25 in a layer that is limited to a certain thickness by the limiting member 41 and conveyed toward the development area D by the rotation of the developing roller 25. Predetermined bias voltage is applied to the developing roller 25 to generate a potential difference between the developing roller 25 and the photosensitive drum 11. Thus, the toner on the developing roller 25 is supplied to the photosensitive drum 11 at the development area D. As a result, an electrostatic latent image on the photosensitive drum 11 is developed into a toner image. In a situation in which the toner in the developer container 22 is reduced as a result of the development, the toner stored in the toner container 20 (see FIG. 1) is supplied to an upstream end (see FIG. 3) of a first conveyance path 22*c* through a toner supply inlet 22*a*.

Figure 3:
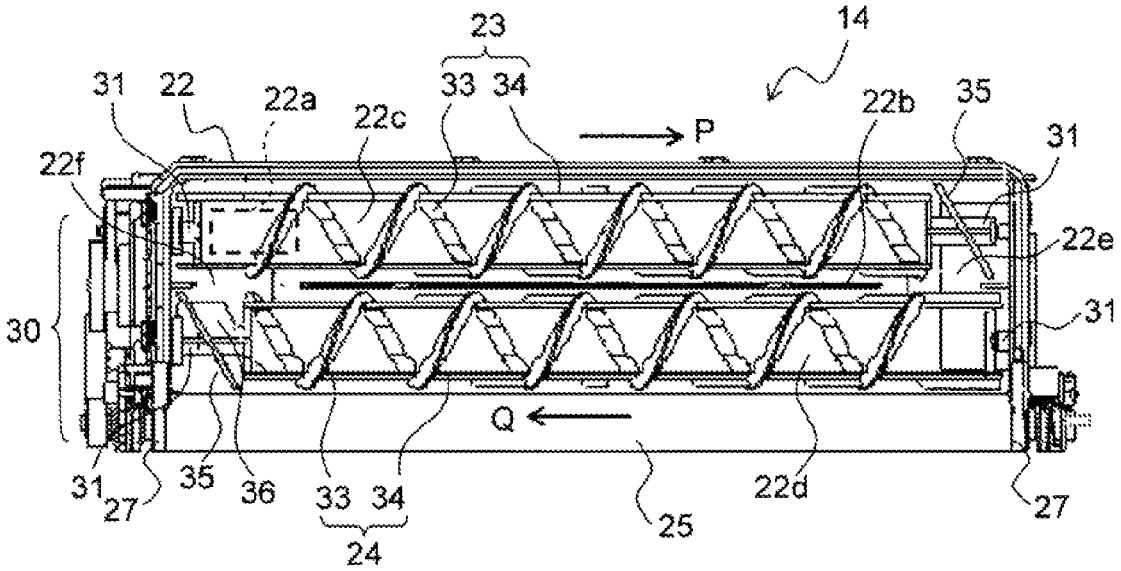
FIG. 3 is a top view of a stirring section of the developing device according to the embodiment of the present disclosure.
Figure 4:
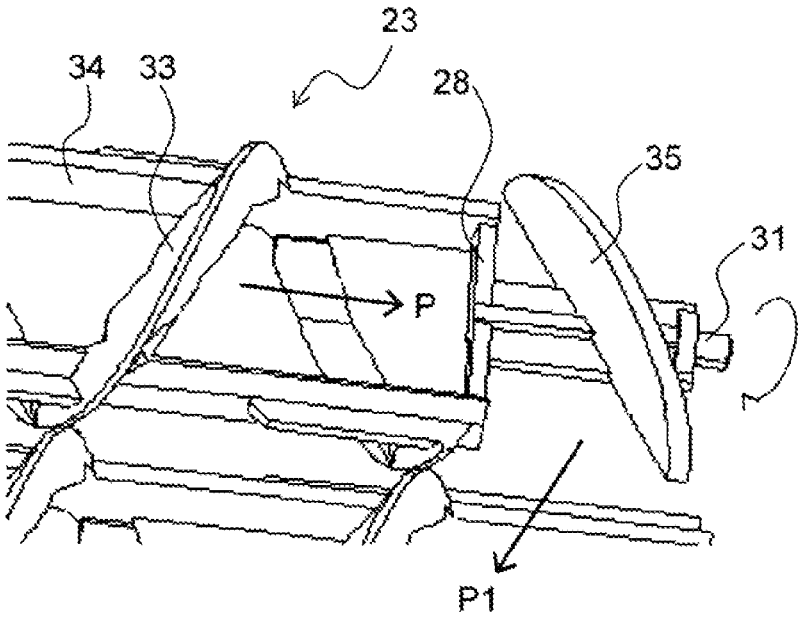
FIG. 4 is a perspective view of a part around a conveyance fin of a first stirring conveyance member that is used in the developing device according to the embodiment of the present disclosure.
Figure 5:
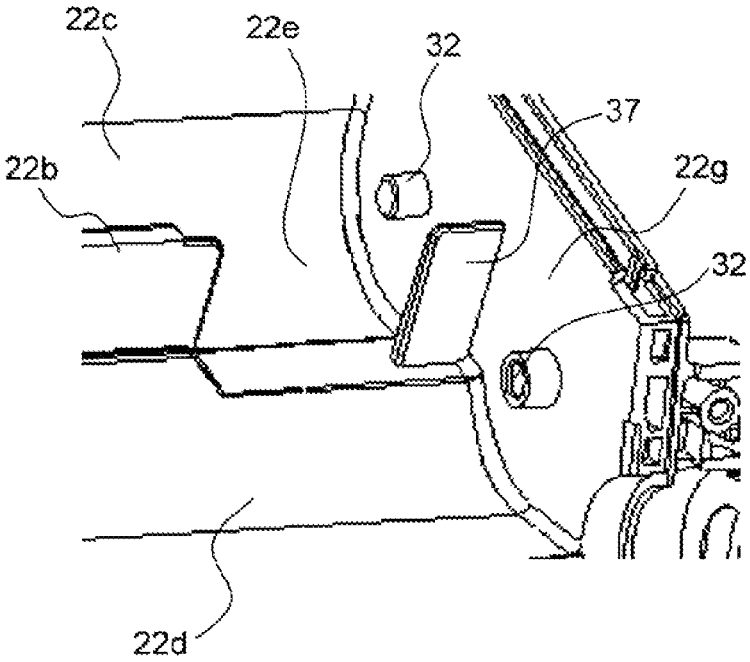
FIG. 5 is a perspective view of a part around a first communication section of a developer container that is used in the developing device according to the embodiment of the present disclosure.
Figure 6:
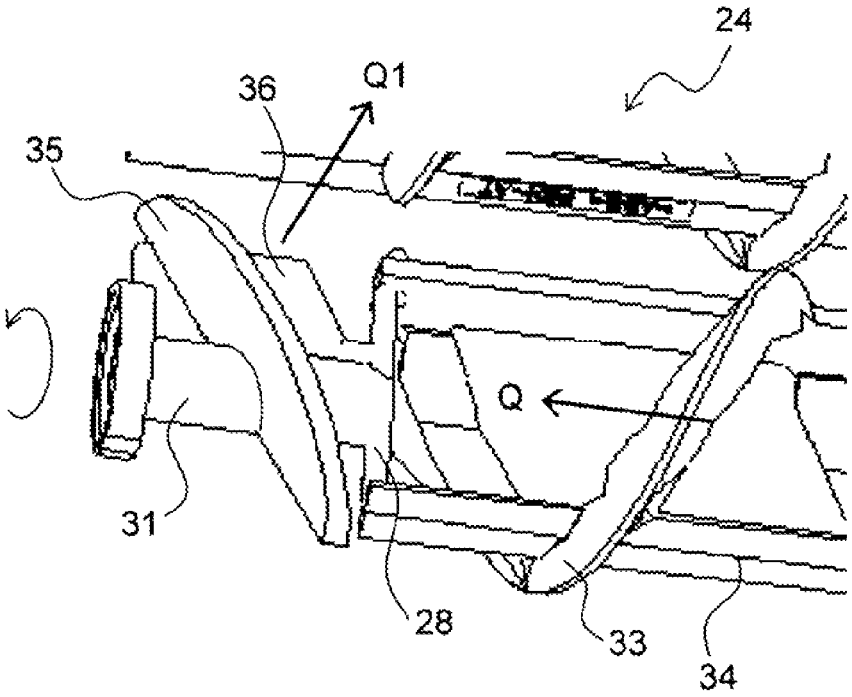
FIG. 6 is a perspective view of a part around a conveyance fin of a second stirring conveyance member that is used in the developing device according to the embodiment of the present disclosure.
Figure 7:
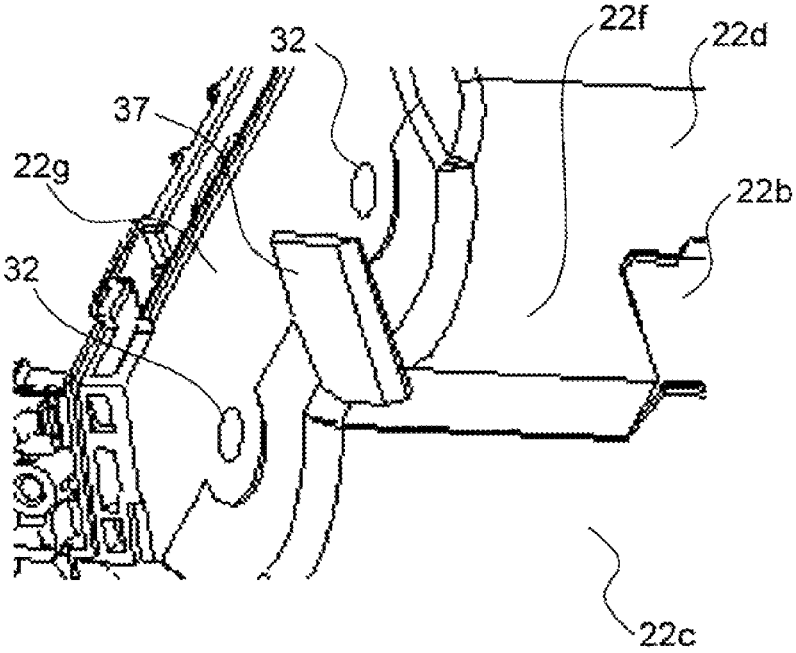
FIG. 7 is a perspective view of a part around a second communication section of the developer container that is used in the developing device according to the embodiment of the present disclosure.
Figure 8:
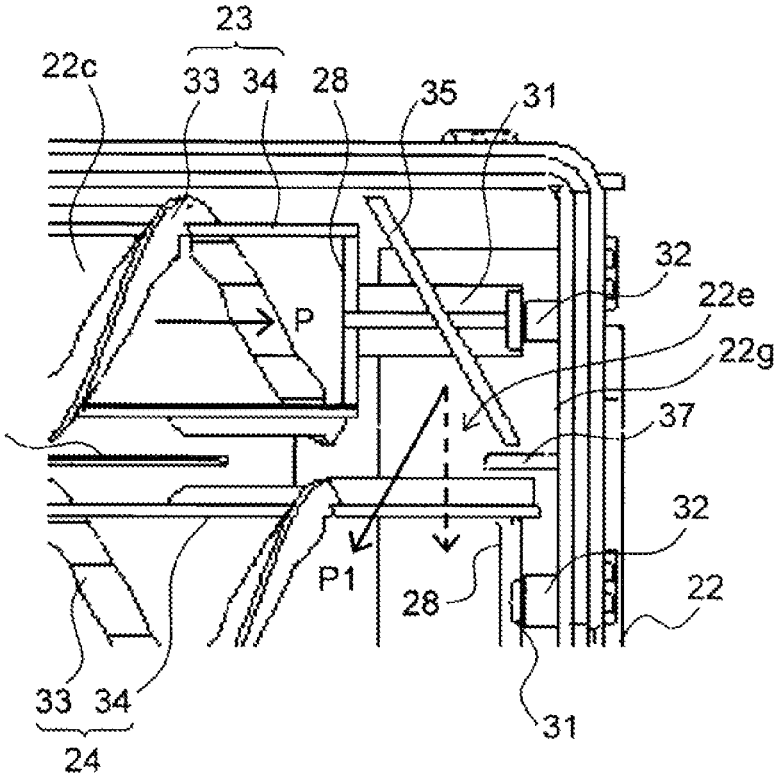
FIG. 8 is a top view of a part of the stirring section of the developing device according to the embodiment of the present disclosure around the first communication section.
Figure 9:
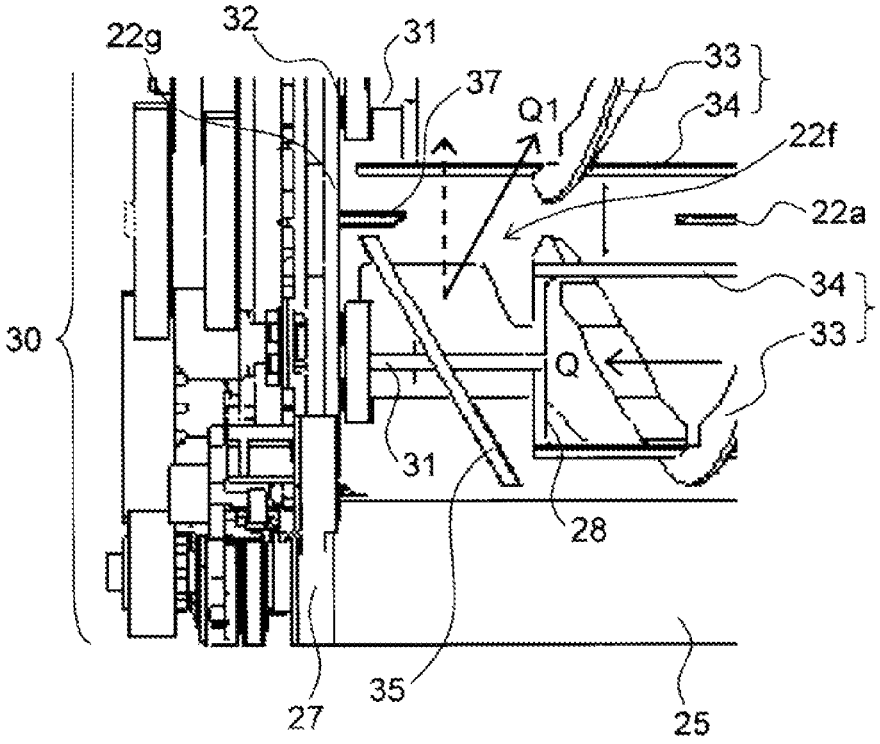
FIG. 9 is a top view of a part of the stirring section of the developing device according to the embodiment of the present disclosure around the second communication section.

Next, a stirring section of the developing device 14 will be described in detail with reference to FIGS. 3-9. FIG. 3 is a cross sectional top plan view of the stirring section of the developing device 14. FIG. 4 is a perspective view of a part around a conveyance fin 35 of the first stirring conveyance member 23. FIG. 5 is a perspective view of a part around the first communication section 22*e* of the developer container 22. FIG. 6 is a perspective view of a part around a conveyance fin 35 of the second stirring conveyance member 24. FIG. 7 is a perspective view of a part around the second communication section 22*f* of the developer container 22. FIG. 8 is a top view of a part of the stirring section of the developing device 14 around the first communication section 22*e*. FIG. 9 is a top view of a part of the stirring section of the developing device 14 around the second communication section 22*f*.

The first conveyance path 22*c* (developer conveyance path), the second conveyance path 22*d* (developer conveyance path), the partition wall 22*b*, the first communication section 22*e*, and the second communication section 22*f* are formed in the developer container 22. The partition wall 22*b* is elongated in the longitudinal direction of the developer container 22 and divides the developer container 22 into the first conveyance path 22*c* and the second conveyance path 22*d* such that these paths are in parallel. A longitudinal end of the partition wall 22*b* (right end on the page of FIG. 3) and a side wall of the developer container 22 define the first communication section 22*e*. That is, the first communication section 22*e* is a space between the partition wall 22*b* and an inner side wall 22*g* of the developer container 22. The other longitudinal end of the partition wall 22*b* (left end on the page of FIG. 3) and the other side wall of the developer container 22 define the second communication section 22*f*. That is, the second communication section 22*f* is a space between the partition wall 22*b* and an inner side wall 22*g* of the developer container 22. Each of the first and second communication sections 22*e* and 22*f* is open so that the toner can be transferred between the first conveyance path 22*c* and the second conveyance path 22*d*. That is, the first conveyance path 22*c*, the first communication section 22*e*, the second conveyance path 22*d*, and the second communication section 22*f* define a toner circulation pathway in the developer container 22.

The first stirring conveyance member 23 and the second stirring conveyance member 24 are disposed corresponding to the first conveyance path 22*c* and the second conveyance path 22*d*, respectively. More specifically, the first stirring conveyance member 23 is disposed in the first conveyance path 22*c*. The second stirring conveyance member 24 is disposed in the second conveyance path 22*d*.

Each of the first stirring conveyance member 23 and the second stirring conveyance member 24 has a pair of rotational shafts 31, a pair of flange portions 28, a helical blade 33 with a hollow helical shape, and a pair of ribs 34. The pair of rotational shafts 31 is rotatably supported by the inner side walls 22*g* at opposite longitudinal ends of the developer container 22. The pair of flange portions 28 is connected with the pair of rotational shafts 31. The helical blade 33 is formed between the pair of flange portions 28 into a helical shape on a constant pitch in an axial direction of the rotational shafts 31. The helical blade 33 rotates in conjunction with the rotational shafts 31. The ribs 34 are substantially parallel to one another and hold the helical blade 33 while rotating in order to prevent the helical blade 33 from becoming eccentric relative to the axis of the rotational shafts 31 as it rotates. The first stirring conveyance member 23 is disposed along a longitudinal direction of the first conveyance path 22*c*, and stirs and conveys the toner in the first conveyance path 22*c*. The second stirring conveyance member 24 is disposed along a longitudinal direction of the second conveyance path 22*d*, and stirs and conveys the toner in the second conveyance path 22*d* in a direction opposite to a direction of conveyance by the first stirring conveyance member 23.

The first stirring conveyance member 23 and the second stirring conveyance member 24 are rotated in the same direction by a drive mechanism 30 including a motor and gears, and thus the helical blade 33 of the first stirring conveyance member 23 rotates in a specified direction. As a result, the toner is stirred and conveyed by the helical blade 33 in a direction indicated by arrow P in the first conveyance path 22*c*. The toner is conveyed in the first conveyance path 22*c* while being stirred and dispersed around an outer edge of the helical blade 33 and through a hollow space of the helical blade 33. The toner is then conveyed into the second conveyance path 22*d* through the first communication section 22*e*.

The helical blade 33 of the second stirring conveyance member 24 also rotates in the specified direction, and the toner is stirred and conveyed by the helical blade 33 in a direction indicated by arrow Q in the second conveyance path 22*d*. The toner is conveyed in the second conveyance path 22*d* while being stirred and dispersed around an outer edge of the helical blade 33 and through a hollow space of the helical blade 33. The toner is then conveyed into the first conveyance path 22*c* through the second communication section 22*f*.

The developing roller 25 is disposed adjacent to the second conveyance path 22*d* so as to bear the toner from the second conveyance path 22*d* on the surface thereof.

As illustrated in FIGS. 4 and 6, each of the first stirring conveyance member 23 and the second stirring conveyance member 24 has the helical blade 33, the pair of ribs 34, the pair of flange portions 28, and the pair of rotational shafts 31. FIGS. 4 and 6 show only one of the pair of flange portions 28 and only one of the pair of rotational shafts 31. Each flange portion 28 is rod-shaped, and ends of the ribs 34 are fixed to each flange portion 28. Each flange portion 28 is connected with a corresponding rotational shaft 31. The helical blade 33, the pair of ribs 34, the pair of flange portions 28, and the pair of rotational shafts 31 in each of the first stirring conveyance member 23 and the second stirring conveyance member 24 are formed integrally from a resin such as an ABS resin that is resistant to adhesion of toner.

In the present embodiment, the helical blade 33 of the second stirring conveyance member 24 has a different orientation in phase than the helical blade 33 of the first stirring conveyance member 23. Accordingly, the rotation of the first stirring conveyance member 23 and the rotation of the second stirring conveyance member 24 in the same direction cause the toner in the developer container 22 to be stirred while circulating from the first conveyance path 22*c* through the first communication section 22*e* and the second conveyance path 22*d* to the second communication section 22*f*. Eventually, the toner thus stirred is supplied to the developing roller 25. In an alternative configuration, the helical blade 33 of the second stirring conveyance member 24 may have the same orientation in phase as the helical blade 33 of the first stirring conveyance member 23, and the first stirring conveyance member 23 and the second stirring conveyance member 24 may be rotated in opposite directions by the drive mechanism 30.

The outer edge of each helical blade 33 has a substantially circular shape as viewed in the axial direction of the rotational shafts 31. An inner edge of each helical blade 33 has a polygonal shape such as a rectangle as viewed in the axial direction of the rotational shafts 31. The inner edge of the helical blade 33 defines the periphery of the hollow space having a polygonal shape such as a rectangle. Each helical blade 33 has a thickness (width in the longitudinal direction) that is smallest at the outer edge and gradually increases toward the inner edge. Each helical blade 33 extends in a helical shape from one of the pair of rotational shafts 31 to the other. The shape of the hollow space is not limited to a rectangle and may be for example a pentagon, a hexagon, an octagon, or a circle.

Each rib 34 is disposed between surfaces of each helical blade 33 that are facing toward one another. The ribs 34 each extend in a straight line and are disposed along the inner edge of each helical blade 33. Each pair of ribs 34 is located symmetrically relative to a straight line connecting the rotational shafts 31. Each rib 34 is formed so as to penetrate all the surfaces of each helical blade 33 that are facing toward one another, and extend beyond the helical blade 33 in terms of the longitudinal direction of the helical blade 33. Opposite ends of each rib 34 are connected with the pair of flange portions 28. Three or more ribs 34 may be disposed at regular intervals along the inner edge of each helical blade 33.

The pairs of flange portions 28 are formed corresponding to the pairs of rotational shafts 31. Each flange portion 28 is rod-shaped and elongated in a radial direction of the corresponding rotational shaft 31. Opposite ends of one of each pair of flange portions 28 are connected integrally with the ends of the corresponding pair of ribs 34 at one side, from where the ribs 34 extend in a direction opposite to a direction in which the rotational shaft 31 extend. Opposite ends of the other of each pair of flange portions 28 are connected integrally with the ends of the corresponding pair of ribs 34 at the other side, from where the ribs 34 extend in the direction opposite to the direction in which the rotational shaft 31 extend.

As illustrated in FIG. 4, the rotational shaft 31 opposite to the first communication section 22*e* (see FIG. 5) of the first stirring conveyance member 23 is provided with a conveyance fin 35 having a semicircular shape as viewed in the axial direction of the rotational shaft 31. The rotational shaft 31 and the conveyance fin 35 are integrated. The conveyance fin 35 protrudes perpendicular to an outer circumferential surface of the rotational shaft 31 so as to be at a specified angle to the axial direction of the rotational shaft 31. The conveyance fin 35 conveys the toner toward the first communication section 22*e*.

As illustrated in FIG. 6, the rotational shaft 31 opposite to the second communication section 22*f* (see FIG. 7) of the second stirring conveyance member 24 is provided with a conveyance fin 35 having a semicircular shape as viewed in the axial direction of the rotational shaft 31 and a conveyance paddle 36 having a trapezoidal shape in a plan view. The rotational shaft 31, the conveyance fin 35, and the conveyance paddle 36 are integrated. The conveyance paddle 36 is integrated with the rotational shaft 31 such that it is in parallel to the axial direction of the rotational shaft 31. The conveyance paddle 36 conveys the toner toward the second communication section 22*f*. The conveyance fin 35 protrudes perpendicular to a point of an outer circumferential surface of the rotational shaft 31 and to the conveyance paddle 36 so as to be at a specified angle to the axial direction of the rotational shaft 31. The conveyance fin 35 protrudes perpendicularly from one surface of the conveyance paddle 36. The conveyance fin 35 conveys the toner toward the second communication section 22*e*.

As illustrated in FIGS. 5 and 7, bearing sections 32 that rotatably support the rotational shafts 31 of the first stirring conveyance member 23 and the second stirring conveyance member 24 are formed in the inner side walls 22*g* at the opposite longitudinal ends of the developer container 22. Each of the inner side walls 22*g* has a reinforcing rib 37 protruding therefrom. More specifically, one of the reinforcing ribs 37 protrudes from one of the inner side walls 22*g* of the developer container 22 and is disposed at a location clear from a pathway of toner conveyance by the conveyance fin 35 in the first communication section 22*e*. The other of the reinforcing ribs 37 protrudes from the other of the inner side walls 22*g* of the developer container 22 and is disposed at a location clear from a pathway of toner conveyance by the conveyance fin 35 in the second communication section 22*f*. The reinforcing ribs 37 assure strength of the inner side walls 22*g* that is enough for the rotation of the first stirring conveyance member 23 and the second stirring conveyance member 24.

In the present embodiment, the semicircular conveyance fin 35 formed at a location opposite to the first communication section 22*e* (see FIG. 3) of the first stirring conveyance member 23 is inclined at a specified angle to the rotational shaft 31 so that the toner being conveyed is turned by the conveyance fin 35 in a direction (direction indicated by arrow P1) at an acute angle to a direction (direction indicated by arrow P) of the toner conveyance by the helical blade 33 in the first conveyance path 22*c*. Likewise, the semicircular conveyance fin 35 formed at a location opposite to the second communication section 22*f* (see FIG. 3) of the second stirring conveyance member 24 is inclined at a specified angle to the rotational shaft 31 so that the toner being conveyed is turned by the conveyance fin 35 in a direction (direction indicated by arrow Q1) at an acute angle to a direction (direction indicated by arrow Q) of the toner conveyance by the helical blade 33 in the second conveyance path 22*d*. The conveyance fin 35 of the first stirring conveyance member 23 has a larger outer diameter than the helical blade 33 of the first stirring conveyance member 23. The conveyance fin 35 of the second stirring conveyance member 24 has a larger outer diameter than the helical blade 33 of the second stirring conveyance member 24.

According to the configuration of the present embodiment, as illustrated in FIG. 8, the toner conveyed in the first conveyance path 22*c* in the direction indicated by arrow P is conveyed toward the first communication section 22*e* by the conveyance fin 35 located at a downstream end of the first stirring conveyance member 23 in terms of the toner conveyance direction. In this situation, the toner is not conveyed in a direction (direction indicated by a dashed arrow) parallel to a communication direction of the first communication section 22*e* but is conveyed in a direction away from the inner side wall 22*g* (direction indicated by arrow P1).

As illustrated in FIG. 9, the toner conveyed in the second conveyance path 22*d* in the direction indicated by arrow Q is conveyed toward the second communication section 22*f* by the conveyance fin 35 located at a downstream end of the second stirring conveyance member 24 in terms of the toner conveyance direction. In this situation, the toner is not conveyed in a direction (direction indicated by a dashed arrow) parallel to a communication direction of the second communication section 22*f* but is conveyed in a direction away from the inner side wall 22*g* (direction indicated by arrow Q1).

This configuration prevents interference of the toner conveyed by each conveyance fin 35 with each reinforcing rib 37, and therefore the toner is conveyed smoothly from the first conveyance path 22*c* to the second conveyance path 22*d* through the first communication section 22*e*. Likewise, the toner is conveyed smoothly from the second conveyance path 22*d* to the first conveyance path 22*c* through the second communication section 22*f*. Thus, the strength of the developer container 22 can be increased without preventing smooth toner conveyance.

Furthermore, the above-described configuration reduces accumulation of the toner around the first communication section 22*e* and around the second communication section 22*f*. Accordingly, the torque needed for toner conveyance in the developer container 22 is reduced. As a result, an inexpensive lower torque motor can be used as a drive source for rotationally driving the first stirring conveyance member 23 and the second stirring conveyance member 24, and power consumption by the motor can be reduced.

In addition, pressure from the toner onto the side seals 27 is reduced, preventing the toner from going through the side seals 27. Accordingly, an inexpensive contact seal can be used for the side seals 27 to prevent toner leakage. It is therefore unnecessary to use an expensive non-contact magnetic seal, achieving cost reduction for the developing device 14. If the non-contact magnetic seal is still used, the configuration can prevent toner leakage more reliably.

In particular, since the second stirring conveyance member 24 disposed in the second conveyance path 22*d*, which is closer to the side seals 27, is provided with the conveyance paddle 36 in addition to the conveyance fin 35, the toner is conveyed more efficiently from the second conveyance path 22*d* to the second communication section 22*f*. Accordingly, pressure from the toner onto the side seals 27 can be reduced more effectively.

Since each conveyance fin 35 has a larger outer diameter than the corresponding helical blade 33, the toner conveyed by the rotation of each helical blade 33 can be scooped at once off the inner walls of the developer container 22 and conveyed to the first communication section 22*e* and the second communication section 22*f* efficiently. The accumulation of the toner around the first communication section 22*e* and around the second communication section 22*f* can therefore be reduced more effectively.

The shape of the conveyance fins 35 is not limited to a semicircular shape, and a conveyance fin 35 having a circular shape may be formed along the entire periphery of each rotational shaft 31, for example. However, the conveyance fins 35 having a semicircular shape as in the present embodiment create areas that are subjected to conveying force by the conveyance fins 35 and areas that are not. As a result, it is possible to allow the toner to appropriately accumulate around the first communication section 22*e* and around the second communication section 22*f* while reducing pressure from the toner onto the side seals 27. At the same time, it is possible to supply a sufficient amount of toner to the opposite longitudinal ends of the developing roller 25.

The present disclosure is not limited to the above-described embodiments. Various alternations can be made thereto within the scope not departing from the effect of the present disclosure. For example, although the first stirring conveyance member 23 and the second stirring conveyance member 24 are each formed from the pair of shafts 31 and the helical blade 33 with a hollow helical shape between the shafts 31 in the above-described embodiment, a screw-shaped member having a rotational shaft and a helical blade formed along an outer circumferential surface of the rotational shaft may be used for the first stirring conveyance member 23 and the second stirring conveyance member 24. Alternatively, the stirring conveyance members are not limited to helical blades and may be for example members including a rotational shaft and a plurality of half-moon-shaped plates (each obtained by dividing a circular plate in half) alternately arranged at a specified inclination angle around the rotational shaft.

In a configuration in which the first stirring conveyance member 23 and the second stirring conveyance member 24 each having a helical blade 33 with a hollow helical shape are used as in the present embodiment, the hollow space of each helical blade 33 facilitates supply of toner to the developing roller 25 but reduces toner conveying force. As a result, the toner may easily accumulate around the first communication section 22*e* and around the second communication section 22*f*. It is therefore particularly effective to combine the conveyance fins 35 and the first stirring conveyance member 23 and the second stirring conveyance member 24 each having a helical blade 33 with a hollow helical shape.

The conveyance fins 35 are provided to both the first stirring conveyance member 23 and the second stirring conveyance member 24 in the above-described embodiment. Alternatively, a conveyance fin 35 may be provided to one of the first stirring conveyance member 23 and the second stirring conveyance member 24. In this configuration, it is preferable to provide the conveyance fin 35 to the second stirring conveyance member 24, which is closer to the side seals 27 of the developing roller 25.

The embodiment has been described using a one-component developer including only a magnetic toner as an example of the developer. However, the present disclosure is not limited to the embodiment, and a two-component developer including a magnetic carrier and a toner maybe used as the developer.

The present disclosure can be applied to various image forming apparatuses including a developing device as well as to the monochrome printer shown in FIG. 1. For example, the present disclosure can be applied to digital- or analogue-type monochrome copiers, color printers, color copiers, and facsimile machines.

The present disclosure is applicable to developing devices including helical blades for stirring and conveying a developer that is used in copiers, printers, facsimile machines, multifunction peripherals, or the like, and to image forming apparatuses including such developing devices. The present disclosure is applied to provide a developing device that assures satisfactory developer conveyance while easily achieving prevention of developer leakage and reinforcement of a developer container. The present disclosure is also applied to provide an image forming apparatus including the developing device.

According to the present disclosure, a conveyance fin is disposed at a portion of each stirring conveyance member that is located at a downstream end of the corresponding developer conveyance path in terms of the developer conveyance direction and opposite to the corresponding communication section, thereby preventing accumulation of the developer around the communication section and reducing the torque needed for developer conveyance in the developer container. As a result, an inexpensive lower torque motor can be used as a drive source for rotationally driving each stirring conveyance member, and power consumption by the motor can be reduced. Furthermore, pressure from the developer onto side seals for preventing developer leakage from opposite ends of the developer bearing member is reduced, and therefore the developer is prevented from going through the side seals. Thus, developer leakage can be prevented reliably.

What is claimed is:

1. A developing device comprising:

a developer container including a plurality of developer conveyance paths arranged substantially parallel to one another, and communication sections which are located at opposite ends of the developer conveyance paths and through which a developer is transferred;

a developer bearing member rotatably supported by the developer container and configured to bear the developer on a surface thereof; and a plurality of stirring conveyance members disposed corresponding to the plurality of developer conveyance paths, wherein each of the stirring conveyance members is located within the corresponding developer conveyance path and conveys the developer in a longitudinal direction of the developer conveyance path while stirring the developer, each of the stirring conveyance members includes:

rotational shafts in a pair that are rotatably supported by the developer container;

a helical blade extending in a hollow helical shape from one of the pair of rotational shafts to the other; and a plurality of ribs each penetrating surfaces of the helical blade that are facing toward one another, at least one of the stirring conveyance members includes a conveyance fin configured to convey the developer toward one of the communication sections, the conveyance fin protrudes from a portion of the at least one of the stirring conveyance members, the portion being located at a downstream end of the developer conveyance path in terms of a developer conveyance direction in the developer conveyance path and opposite to the one of the communication sections, the conveyance fin is inclined at a specified angle to a direction of the rotational shafts of the at least one of the stirring conveyance members so that the developer being conveyed is turned by the conveyance fin in a direction at an acute angle to the developer conveyance direction in the developer conveyance path, the at least one of the stirring conveyance members further includes, in addition to the conveyance fin, a conveyance paddle that conveys the developer toward the one of the communication sections, the conveyance paddle is disposed parallel to the direction of the rotational shafts and protrudes from a portion of the at least one of the stirring conveyance members, the portion being located at the downstream end of the developer conveyance path in terms of the developer conveyance direction in the developer conveyance path and opposite to the one of the communication sections, the conveyance fin is plate-shaped and protrudes perpendicularly from one surface of the conveyance paddle without forming a helix, and the conveyance fin has a larger outer diameter than the helical blade.

2. The developing device according to claim 1, wherein each of the communication sections is a space between an inner side wall of the developer container and a partition wall dividing an inner space of the developer container into the plurality of developer conveyance paths, the developer container includes a reinforcing rib, and the reinforcing rib protrudes from the inner side wall of the developer container and is disposed at a location clear from a pathway of developer conveyance by the conveyance fin in the one of the communication sections.

3. The developing device according to claim 1, wherein the conveyance fin has a semicircular shape as viewed in the direction of the rotational shafts of the at least one of the stirring conveyance members.

4. The developing device according to claim 1, wherein the plurality of developer conveyance paths include a first conveyance path and a second conveyance path arranged substantially parallel to one another, the plurality of stirring conveyance members include a first stirring conveyance member that stirs and conveys the developer in the first conveyance path, and a second stirring conveyance member that stirs and conveys the developer in the second conveyance path in a direction opposite to a direction of conveyance by the first stirring conveyance member, the developer bearing member is disposed adjacent to the second conveyance path and configured to bear on the surface thereof the developer from the second conveyance path, and at least the second stirring conveyance member includes the conveyance fin.

5. The developing device according to claim 1, wherein the conveyance fin conveys the developer in a direction away from an inner side wall of the developer container.

6. The developing device according to claim 1, wherein the conveyance fin protrudes perpendicular to a point of an outer circumferential surface of one of the rotational shafts and to the conveyance paddle.

7. The developing device according to claim 1, further comprising a pair of side seals disposed at opposite axial ends of the developer bearing member.

8. An image forming apparatus comprising the developing device according to claim 1.

9. The developing device according to claim 1, wherein the conveyance fin protrudes further outward than an edge of the conveyance paddle that is parallel to the direction of the rotational shafts.

* * * * *